US007268475B1

(12) United States Patent
Jin et al.

(10) Patent No.: US 7,268,475 B1
(45) Date of Patent: Sep. 11, 2007

(54) FIELD EMISSION DEVICES HAVING CORRUGATED SUPPORT PILLARS WITH DISCONTINUOUS CONDUCTIVE COATING

(75) Inventors: Sungho Jin, Millington, NJ (US); Gregory Peter Kochanski, Dunellen, NJ (US); Wei Zhu, North Plainfield, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 08/771,369

(22) Filed: Dec. 16, 1996

Related U.S. Application Data

(63) Continuation of application No. 08/381,378, filed on Jan. 31, 1995, now abandoned.

(51) Int. Cl.
*H01J 1/88* (2006.01)

(52) U.S. Cl. ..... 313/292; 313/238

(58) Field of Classification Search ..... 313/292, 313/493–497
See application file for complete search history.

(56) References Cited

U.S. PATENT DOCUMENTS 5,561,340 A * 10/1996 Jin et al. ..... 313/309
5,561,343 A * 10/1996 Lowe ..... 313/482
5,939,822 A * 8/1999 Alderson ..... 313/493

* cited by examiner

*Primary Examiner*—Joseph Williams

(57) ABSTRACT

In accordance with the invention, a field emission device is made by providing the device electrodes, forming a plurality of corrugated insulating rods with discontinuous coatings of conductive or semiconductive material with low secondary electron emission coefficient, adhering the rods to an electrode, cutting the rods to define corrugated pillars, and finishing the device. The result is low cost production of a field emission device having superior resistance to breakdown in high field operation.

8 Claims, 8 Drawing Sheets

60

61
60

63
63
60
63

64
64
64

FIELD EMISSION DEVICES HAVING CORRUGATED SUPPORT PILLARS WITH DISCONTINUOUS CONDUCTIVE COATING

This application is a continuation, of application Ser. No. 08/381,378 filed Jan. 31, 1995, now abandoned.

FIELD OF THE INVENTION

This invention relates to methods for making improved field emission devices and, in particular, to methods for making field emission devices, such as flat panel displays, having corrugated and locally conductive support pillars for breakdown resistance.

BACKGROUND OF THE INVENTION

Field emission of electrons into vacuum from suitable cathode materials is useful for a variety of field emission devices including flat panel displays. Support pillars are important components of field emission devices (FEDs). A typical field emission device comprises a cathode including a plurality of field emitter tips and an anode spaced from the cathode. A voltage applied between the anode and cathode induces emission of electrons towards the anode. In flat panel displays an additional electrode called a gate is typically disposed between the anode and cathode to selectively activate desired pixels. The space between the cathode and anode is evacuated, and integrated cylindrical support pillars keep the cathode and anode separated. Without support pillars, the atmospheric pressure outside would force the anode and cathode surfaces together. Pillars are typically 100-1000 μm high and each provides support for an area of 1-10,000 pixels.

While cylindrical pillars may provide adequate mechanical support, they are not well suited for new field emission devices employing higher voltages. Applicants have determined that increasing the operating voltage between the emitting cathode and the anode can substantially increase the efficiency and operating life of a field emission device. For example, in a flat panel display, changing the operating voltage from 500 V to 5000 V could increase the operating life of a typical phosphor by a factor of 100. However, insulator breakdown and arcing along the surface of cylindrical pillars precludes the use of such high voltages.

If a cylindrical insulator is disposed between two electrodes and subjected to a continuous voltage gradient, then emitted electrons colliding with the dielectric can stimulate the emission of secondary electrons. These secondary electrons in turn accelerate toward the positive electrode. This secondary emission can lead to a runaway process where the insulator becomes positively charged and an arc forms along the surface. Accordingly, there is a need for a new pillar design that will permit the use of higher voltages without arcing.

Co-pending applications "Method For Making Field Emission Devices Having Corrugated Support Pillars for Breakdown Resistance" and "Multilayer Pillar Structure For Improved Field Emission Devices" filed concurrently herewith, disclose a corrugated dielectric pillar structure and a multilayer pillar structure, and methods for producing such pillars. These novel structures increase the surface length of the dielectric material and reduce the detrimental effect of secondary electron emission from the pillar surface. The present invention discloses a further improved pillars structure using discontinuous conductor coating with resultant improvement in resistance to breakdown and arcing of the pillars in high voltage environment.

SUMMARY OF THE INVENTION

In accordance with the invention, a field emission device is made by providing the device electrodes, forming a plurality of corrugated insulating rods with discontinuous coatings of conductive or semiconductive material with low secondary electron emission coefficient, adhering the rods to an electrode, cutting the rods to define corrugated pillars, and finishing the device. The result is low cost production of a field emission device having superior resistance to breakdown in high field operation.

BRIEF DESCRIPTION OF THE DRAWING

The nature, advantages and various additional features of the invention will appear more fully upon consideration of the illustrative embodiments now to be described in detail in connection with the accompanying drawings. In the drawings.

It is to be understood that the drawings are for purposes of illustrating the concepts of the invention and are not to scale.

DETAILED DESCRIPTION

There are five considerations in optimal pillar design. First, the optimal pillar design is one where surface paths from negative to positive electrodes are as long as possible for a given pillar height. Second, it is desirable to construct the pillar so that most secondary electrons will re-impact the pillar surface close to the point of their generation, rather than being accelerated a substantial distance toward the positive electrode. This goal is advantageous because most materials generate less than one secondary electron for each incident electron if the incident energy is less than 500V (or more preferably, less than 200V). Under these conditions, secondary electrons will generally not have enough energy to make an increasing number of secondaries of their own. For the purposes of this goal, "close" is defined as a point where the electrostatic potential is less than 500V more positive than the point at which the electron is generated, and preferably less than 200V more positive. Third, it is desirable to construct the pillar out of materials that have secondary electron emission coefficients of less than two, under the normal operating conditions. Fourth, it is desirable to have as much of the surface of the pillar oriented so that the local electric field is nearly normal to the insulator surface, preferably with the field Lines emerging from the surface, so that secondary electrons will be pulled back toward the surface and re-impact with energies less than the abovementioned 200-500V. Fifth, the pillar must not be so much wider at the anode end so that it substantially reduces the area that can be allocated to the phosphor screen.

Where the field emission device is a flat panel display, the pillar material should not only be mechanically strong but also should be an electrical insulator with a high breakdown voltage in order to withstand the high electrical field applied to operate the phosphor of the display. For established phosphorous such as ZnS:Cu, Al, the breakdown voltage should be greater than about 2000 V and preferably greater than 4000 V.

Figure 1:
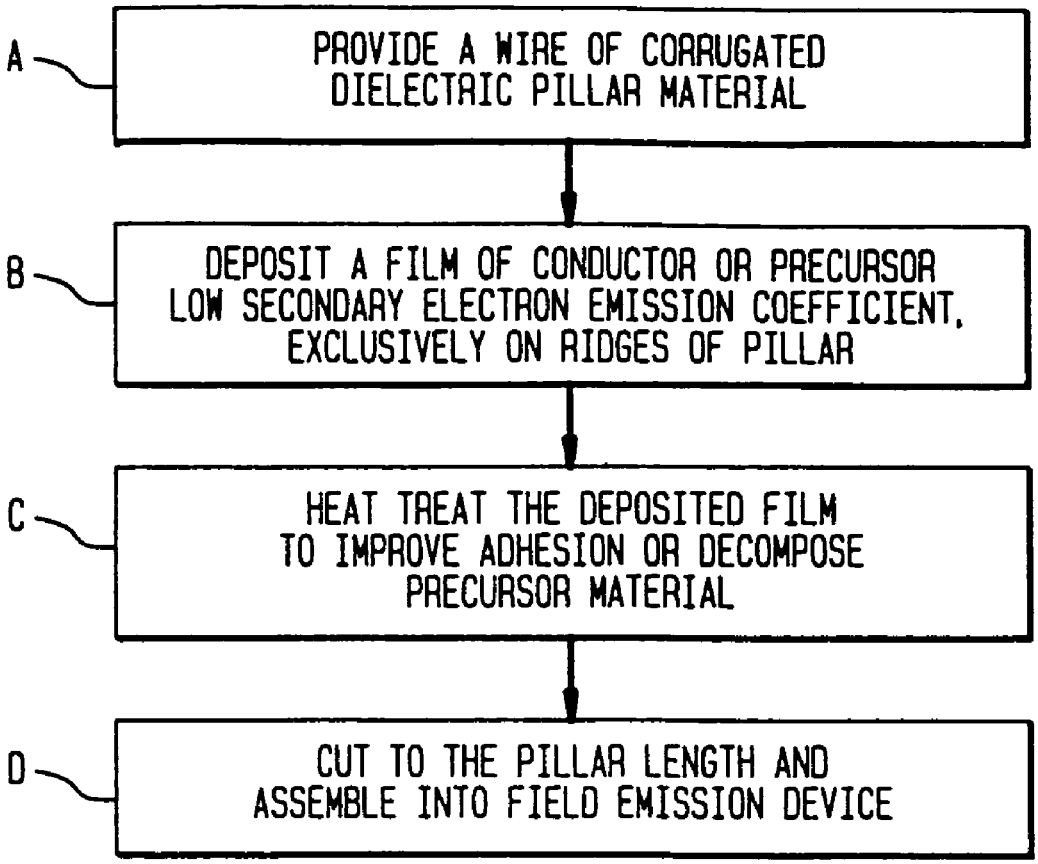
FIG. 1 is a schematic block diagram of the steps in making an improved pillar structure for a field emission device according to the invention.

Referring to the drawings, FIG. 1 is a block diagram of steps in making an improved pillar structure for field emission devices. The first step (block A) is to provide a wire, rod, or plate of corrugated dielectric material. Co-pending application "Method For Making Field Emission Devices Having Corrugated Support Pillars For Breakdown Resistance" describes various methods for making such a corrugated geometry from dielectric materials such as glass, quartz, ceramic materials (oxides, nitrides), polymers and composite materials.

The second step (block B in FIG. 1) is to deposit on the ridges of the corrugations a discontinuous film of conductor or semiconductor material with low secondary electron emission co-efficient, $\delta_{max}$. The coefficient is defined as the ratio of the number of outgoing electrons/number of incoming electrons on a given surface of the material. Insulators typically have high $\delta_{max}$ of 2-20, e.g., 2.9 for glass and −20 for MgO. Conductors or semiconductors typically have low $\delta_{max}$ of less than −2. For FED pillar applications, a $\delta_{max}$ value close to 1 is desirable. $\delta_{max}$ much higher than 1 means undesirable electron multiplication. Among suitable materials for use as a discontinuous coating, according to the invention, on the pillar are metals and semiconductors such as Cu ($\delta_{max}$=1.3), Co (1.2), Ni (1.3), Ti (0.9), Au (1.4), Si (1.1), and compounds such as $Cu_2O$ (1.2), $Ag_2O$ (1.0).

The combination of discontinuous conductor coating on the protruding ridges of the corrugated dielectric pillar with the presence of recessed grooves is particularly useful in improving the resistance to high voltage breakdown, because it provides increased surface length, secondary electron trapping inside the grooves, and minimum electron multiplication on the exposed, protruding surface portion (ridges or peaks) of the corrugated pillar.

Figure 2B:
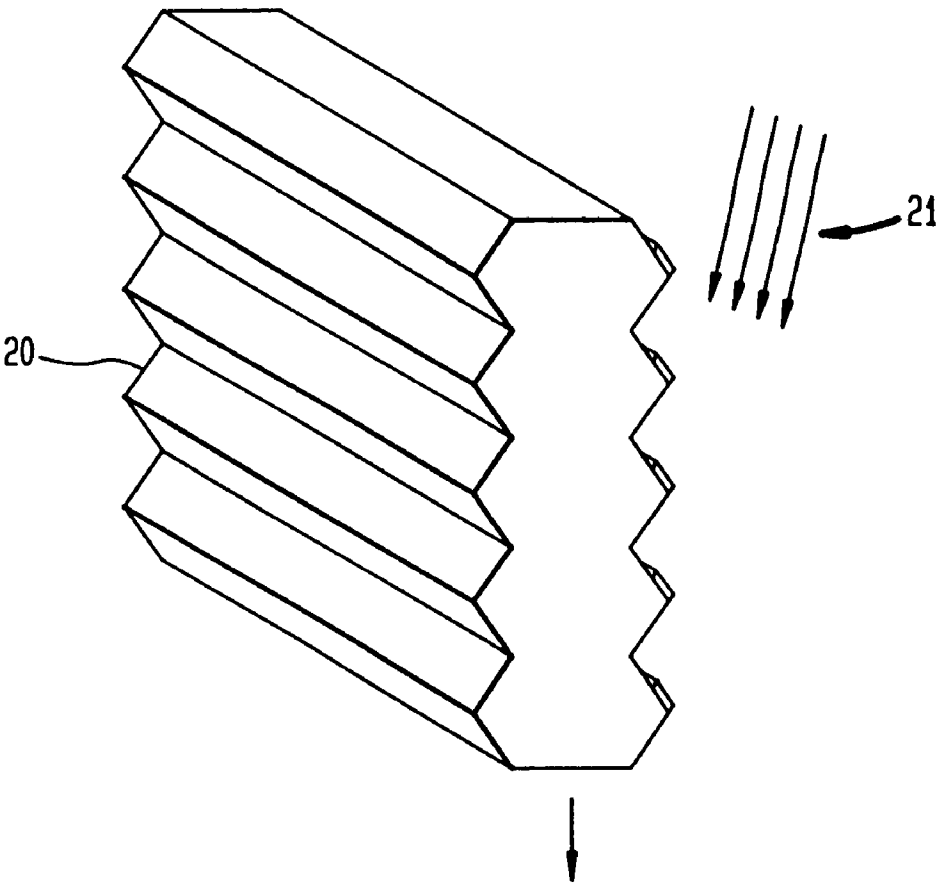
FIGS. 2A and 2B illustrate a first method for making conductor-coating on corrugated rods as used in the process of FIG. 1.
Figure 2A:
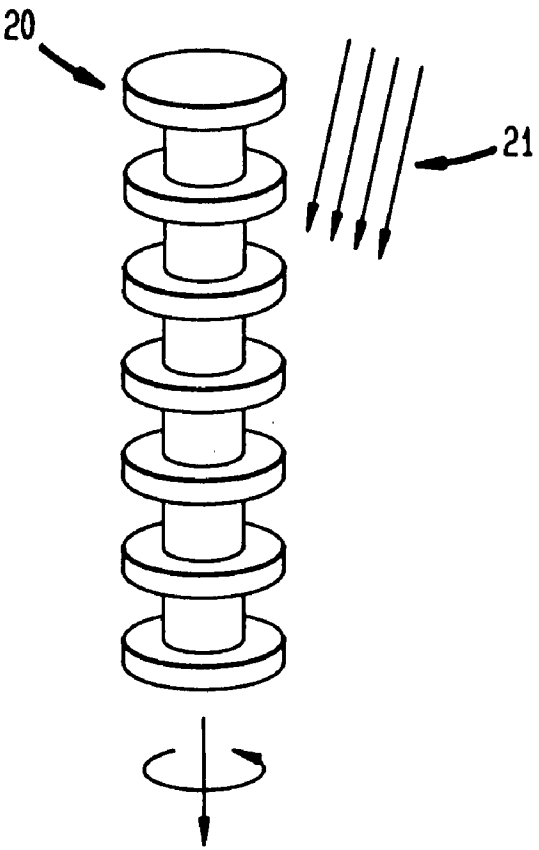

FIGS. 2A and 2B schematically illustrates a first method of selectively adding to a corrugated dielectric body 20 a film of low $\delta_{max}$ material 21 by inclined angle deposition (e.g. using evaporation, sputtering, spray coating technique). Because of the line-of-sight deposition of the film material, the deposition is naturally limited to the ridge or peak portion of the corrugated rod or plate. The deposition can be carried out in a continuous manner if a long wire or plate-shape corrugated material is slowly moved away during deposition. A rotation of the rod can be utilized to ensure uniform deposition on all sides of the wire surface (FIG. 2A).

A low $\delta_{max}$ metal or compound can be directly deposited. Alternatively, a precursor material containing the desired $\delta_{max}$ material may be deposited first and decomposed or pyrolized during the later stage of processing. For example, NiO or $Ni(OH)_2$ may be deposited for Ni coating, and CuO (evaporated) or $CuSO_4$ (spray coated as an aqueous solution, optionally with a binder material added for enhanced adhesion, e.g., polyvinyl alcohol) may be deposited for Cu or $Cu_2O$ coating.

Figure 3:
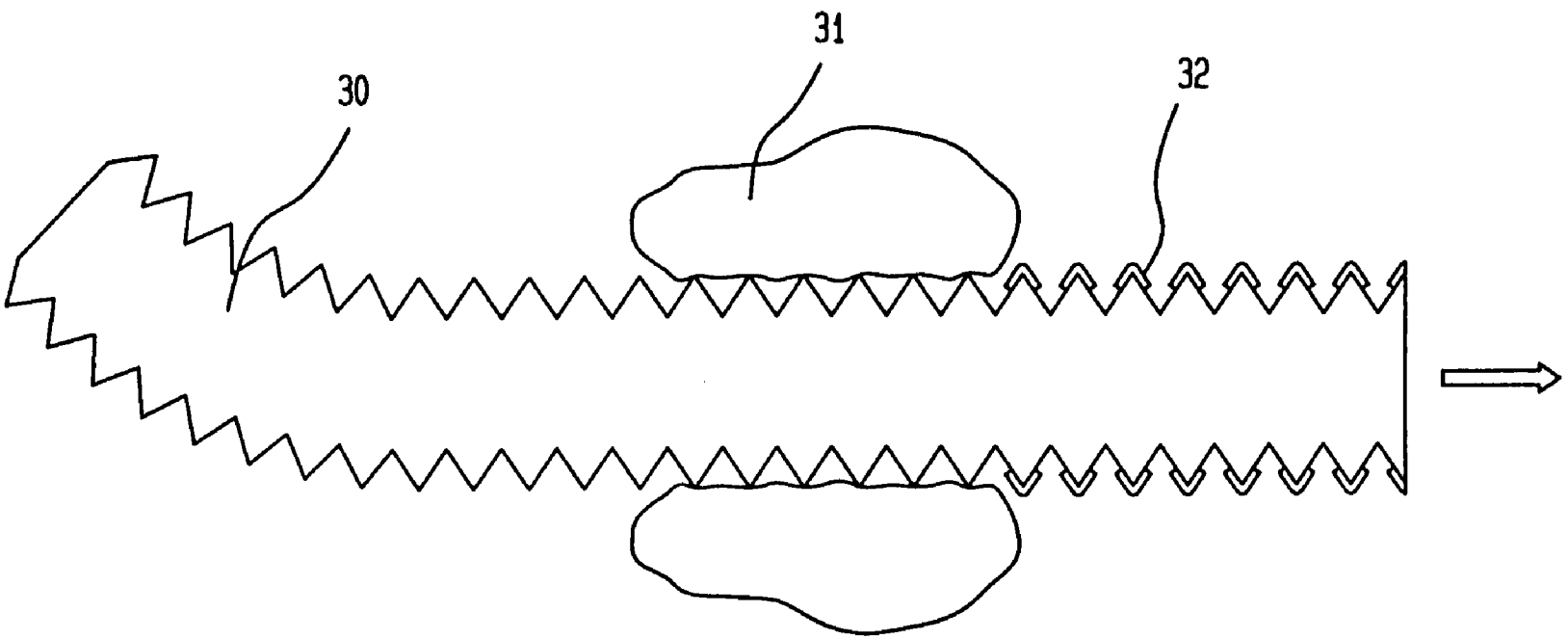
FIG. 3 illustrates a second method for making conductor coating on corrugated rods as used in the process of FIG. 1.

A second method of depositing the discontinuous film of low $\delta_{max}$ material is schematically illustrated in FIG. 3. A wire 30 of corrugated dielectric material is continuously wiped off with a wet cloth 31 or sponge-like material lightly wetted with a suspension or slurry containing fine particles (below −20 μm size, preferably below 2 μm size) of low $\delta_{max}$ material (e.g., Cu, Co, $Cu_2O$, $Ag_2O$) or a precursor liquid (e.g., $CuSO_4$ or $NiCl_2$ solution). The ridges or protruding portion of the dielectric wire is stained with a coating 32 the fine particles, slurry or precursor which is later decomposed, sintered or melted by heat treatment to leave only the desired low $\delta_{max}$ material.

Alternatively, the staining can be made with a catalyst material for ease of subsequent electroless or electrolytic deposition. For example, the wiping cloth in FIG. 3 can be wetted with a palladium-containing solution for staining of the protruding wire surface. Palladium is a known catalyst which promotes adherence of metal to a substrate during electrochemical deposition. After optional intermediate baking process for decomposition of the solution, electroless or electrolytic plating (e.g., with Cu, Sn) is carried out for selective metal deposition on catalyst stained, protruding portion of the grooved dielectric pillar wire.

Figure 4:
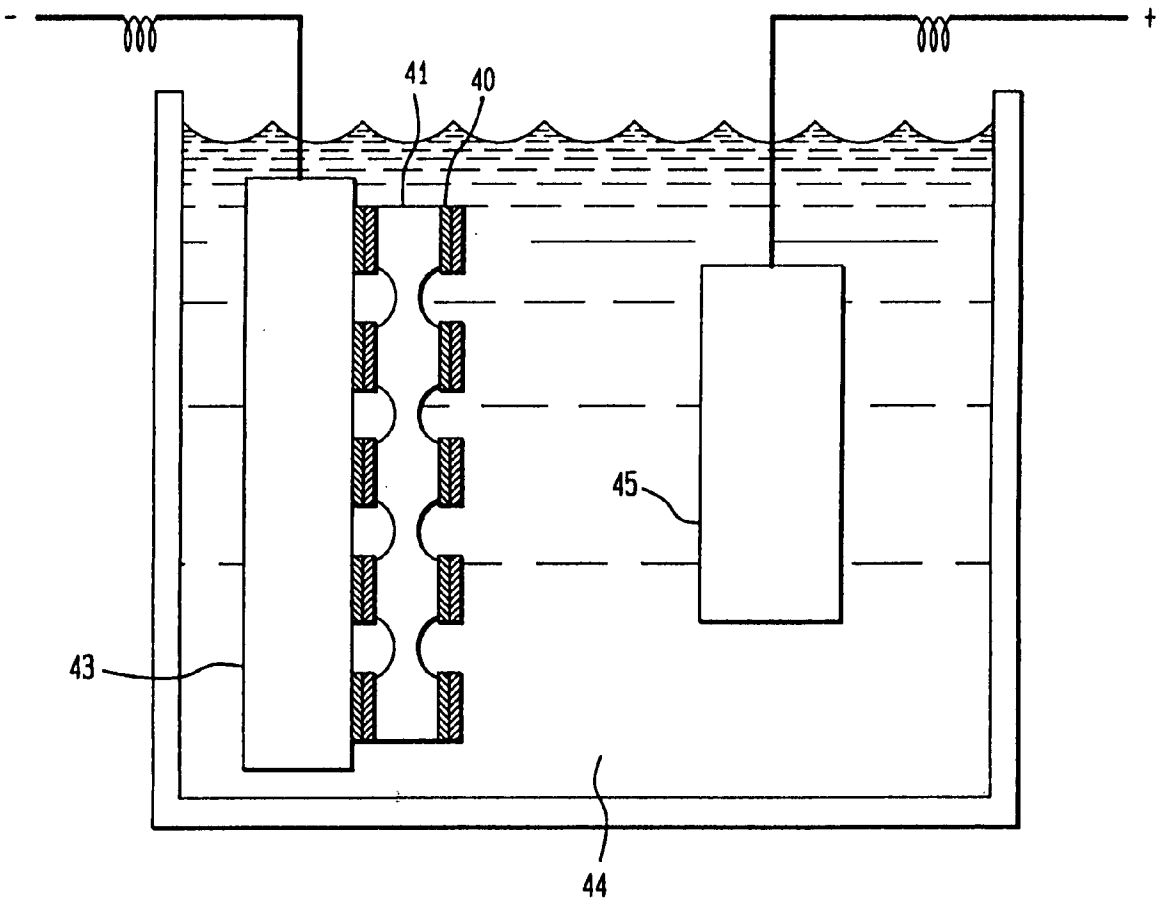
FIG. 4 illustrates a third method for making conductor-coating on corrugated rods as used in the process of FIG. 1.

A third method of discontinuously depositing low $\delta_{max}$ coating is schematically illustrated in FIG. 4. One of the methods for shaping the corrugated structure disclosed in the co-pending application "Method For Making Field Emission Devices Having Corrugated Pillars For Breakdown Resistance" is the use of inert metal mask (such as Au film) to etch out grooves in glass or quartz fiber using hydrofluoric acid. The Au mask used in the etching process can be left on, which is then used as a basis for electroplating of a lower $\delta_{max}$ material (e.g., Co) if desired. The masked, grooved dielectric wire 41 is placed in a bath of electrolyte 44 between a cathode 43 and an anode 45. During the electroplating process of FIG. 4, the Au mask 40 on the dielectric wire 41 is kept in contact with the plating electrode (cathode) 43 by gentle pressing with non-rigid material such as fine metal gauge or conductive elastomer. The wire is advantageously rotated slowly for uniform coating.

The desired thickness of the discontinuous coating of low $\delta_{max}$ material applied by the process of FIG. 1 is typically in the range of 0.005-50 μm and preferably in the range of 0.1-2.0 μm. Microscopically rough film may be preferred as microscopic geometrical trapping in the coating itself reduces the number of secondary electrons from the coating surface.

The next step in FIG. 1 (block C) is to heat treat the deposited film to improve the adhesion or melt, densify the low $\delta_{max}$ material or to decompose the precursor material coating. Typically a hydrogen-containing atmosphere is used for the heat treatment to obtain pure metal or alloy films. Inert, oxygen-containing, or nitrogen-containing atmosphere can be used for heat treatment of oxide, nitride or other compound films. The heat treating temperature and time varies depending on the nature of metals or precursors, but they are typically in the range of 100-900° C. for 0.1-100 hrs.

The final step in FIG. 1 (block D) is to cut the wire into desired pillar length and assemble into field emission display device between the cathode and anode.

Figure 5:
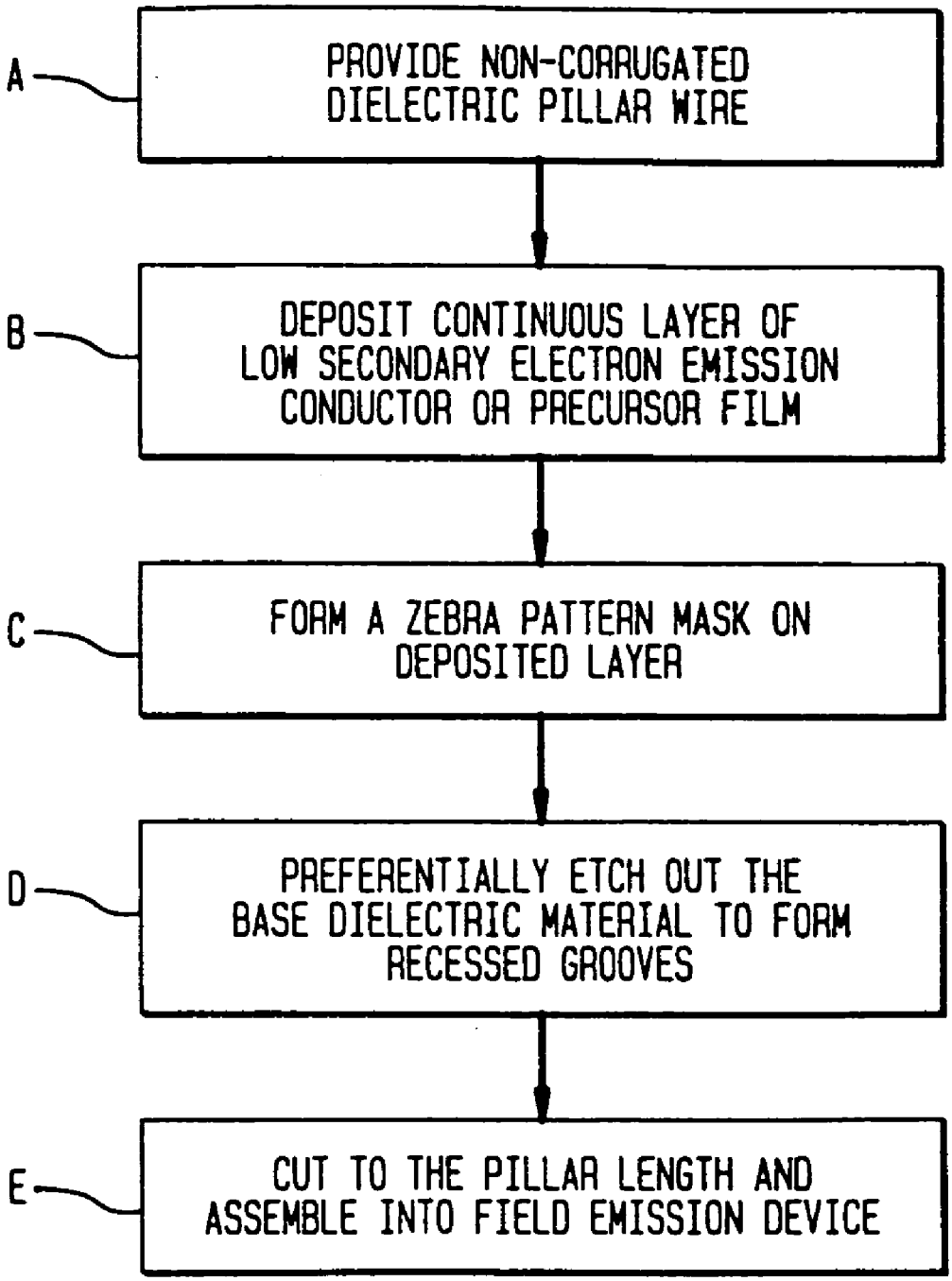
FIG. 5 is a schematic block diagram of the steps for preparing the conductor-coated, corrugated pillar structure from uncorrugated dielectric rods.

Instead of processing on a corrugated wire as described above, a non-corrugated wire can be used as a starting material for processing as illustrated in FIG. 5. The first step shown in block A of FIG. 5 is to provide a non-corrugated dielectric rod or wire such as illustrated in FIG. 6A as rod 60.

The next step shown in FIG. 5, block B is to deposit a continuous layer of low secondary emission conductor or precursor. In FIG. 6B, this layer is denoted by reference numeral 61.

Figures 6A, 6B, 6C, 6D:
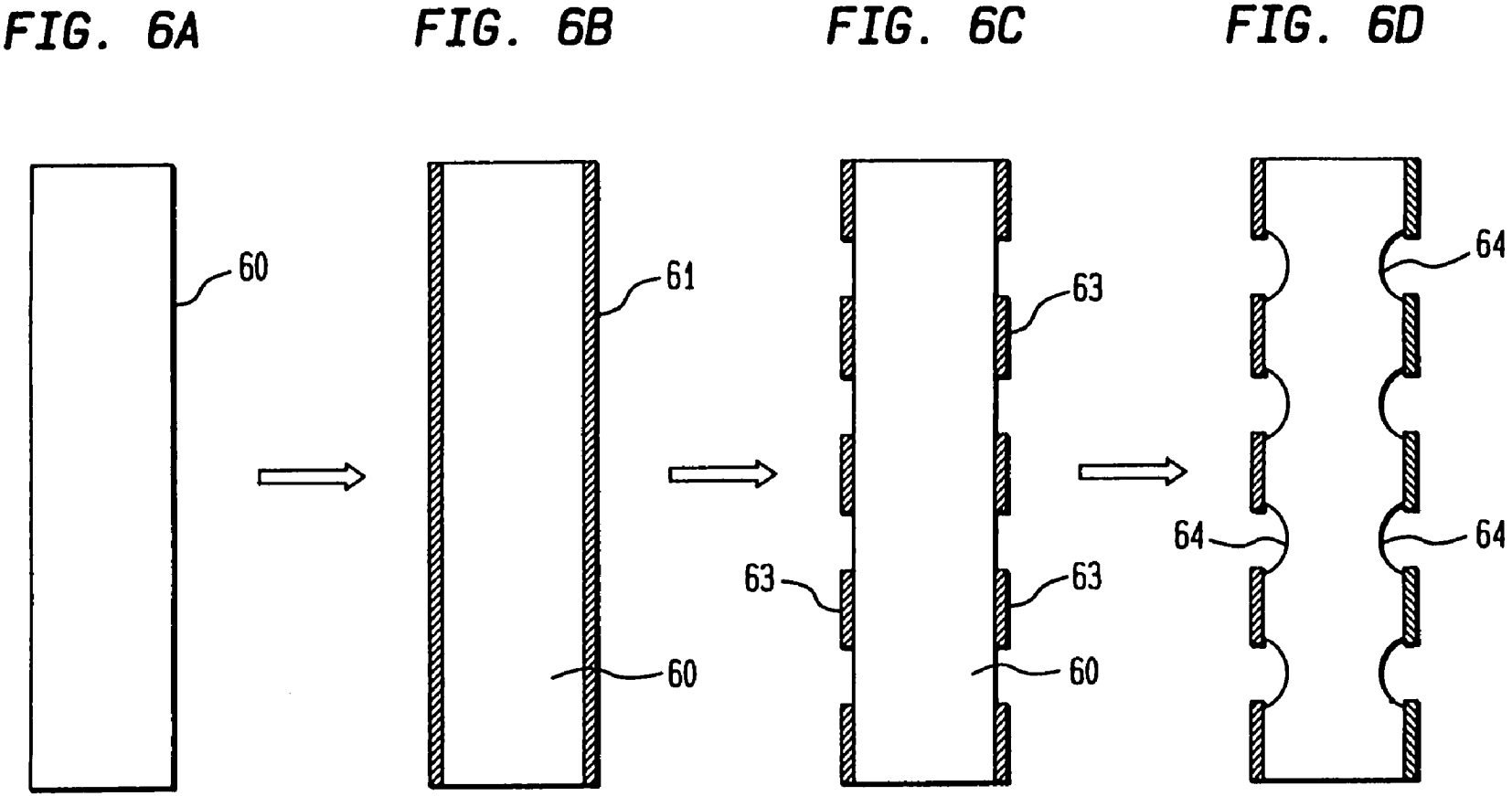
FIGS. 6A through 6D illustrate a method used in the process of FIG. 5.

The third step (FIG. 5, block C) is to mask portions of the coated rod with a metal mask material shown in FIG. 6C as masking elements 63.

The next step in block D of FIG. 5 is to form grooves by preferentially etching the dielectric material. The resulting structure is shown in FIG. 6D with grooves 64.

The metal mask material that resists etching in hydrofluoric acid processing for groove etch-out is chosen in such a way that the metal also has low $\delta_{max}$ characteristics. In such a case, the mask material can be simply kept and used as a low $\delta_{max}$ coating on the exposed ridges, without having to add additional low $\delta_{max}$ metal, thus reducing the processing cost. Such a low $\delta_{max}$ material that resists etching by hydrofluoric acid can be Au itself ($\delta_{max}$=1.4) but an even lower $\delta_{max}$ mask can be accomplished by alloying of Au, or Pt ($\delta_{max}$=1.8) e.g., with a lower $\delta_{max}$ metal such as Co, Cu, Al, etc. The desired alloy composition is 40-80 atomic percent Au, with the remainder made up of the selected alloying elements. Binary or ternary or higher order alloys can be used. The desired alloy is exemplarily first deposited on a round wire of dielectric material as a continuous film (e.g., by physical, chemical, electrochemical means or other known techniques) (FIG. 6B), patterned (e.g., by photolithographic or mechanical means) into a zebra-shape or other vertically discontinuous configuration (FIG. 6C), before subjected to hydrofluoric acid processing as illustrated in FIG. 6D. Alternatively, the zebra-shaped metal layer can be directly obtained by deposition through a patterned mask.

A typical geometry of the pillar is advantageously a modified form of a round or rectangular rod. The diameter or thickness of the pillar is typically 50-1000 μm, and preferably 100-300 μm. The height-to-diameter aspect ratio of the pillar is typically in the range of 1-10, preferably in the range of 2-5. The desired number or density of the pillars is dependent on various factors to be considered. For sufficient mechanical support of the anode plate, a larger number of pillars is desirable, however, in order to reduce the manufacturing cost and to minimize the loss of display pixels for the placement of pillars, some compromise is necessary. A typical density of the pillar is about 0.01-2% of the total display surface area, and preferably 0.05-0.5%. A FED display of about 25×25 $cm^2$ area having approximately 500-2000 pillars, each with a cross-sectional area of 100×100 $\mu m^2$, is a good example.

Figure 7:
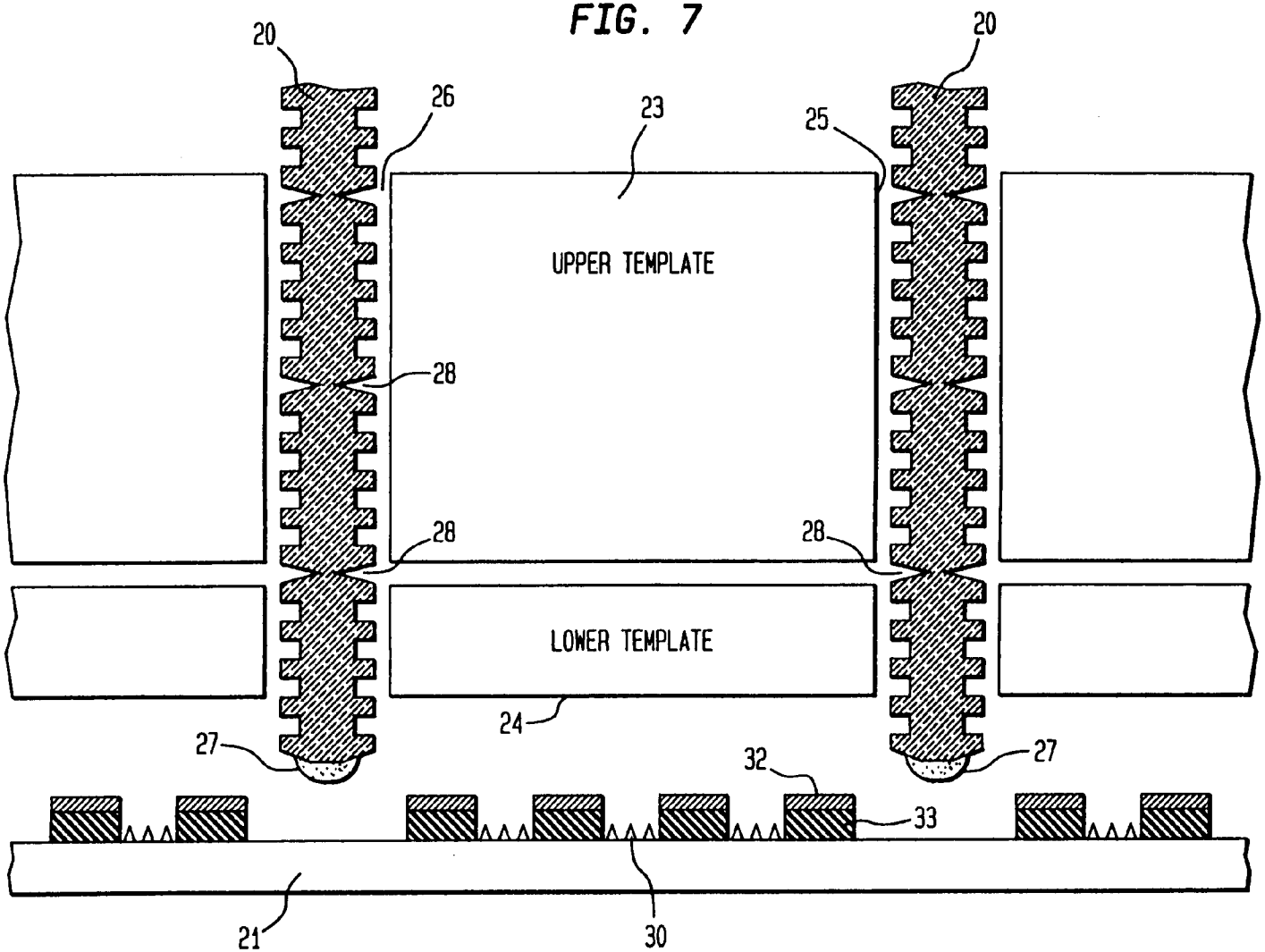
FIG. 7 illustrates an exemplary method of placing the pillars on a FED device.

After the corrugated rods are formed and the low $\delta_{max}$ coating is added, the next step is to adhere the ends of a plurality of rods to an electrode of the field emitting device, preferably the emitting cathode. The placement of pillars on the electrode can conveniently be accomplished by using the apparatus illustrated in FIG. 7. Specifically, a plurality of corrugated rods 20 are applied to an electrode 21 through apertures in a two part template comprising an upper portion 23 and a lower portion 24. In the insertion phase, the apertures 25 and 26 of the upper and lower templates are aligned with each other and with positions on the electrode where pillars are to be adhered. Adhesive spots 27 on the projecting ends of the rods can be provided to unite the rods with electrode 21. Notches 28 are advantageously provided in the rods at desired cutting points so that appropriate length of the rod can be obtained. In the example shown, the electrode is the device cathode emitter including emitter regions 30 on a conductive substrate 21. Conductive gates 32 are separated from the substrate by an insulating layer 33.

For a FED display requiring 1600 pillars, for example, display-sized templates (e.g., a metal sheet with drilled holes at the desired pillar locations), are first prepared. Through one to all of the holes (or typically one row of 40 pillar holes at a time) are simultaneously and continuously supplied long wires of corrugated dielectric material. The protruding bottoms of the wires are wet with adhesive material (such as uncured or semicured epoxy), low melting point glass, solder that is molten or in the paste form or an optical absorbing layer.

The corrugated rods need to be cut into support pillars. This can be advantageously done by shearing with the apparatus of FIG. 7. The upper template 23 is moved sideways while the lower template 24 is fixed with the adhesive in contact with display cathode surface, so that the bottom pillar is broken away at the pre-designed V-notch location 28. This process is repeated for the next display substrate. Since many of the pillars are placed simultaneously, the assembly can be fast and of low cost. If desired, local heating may be supplied by a focused light beam, e.g., a laser, to cure epoxy or to fuse the pillars to the substrate.

The device assembly is completed by applying the other electrode and evacuating and sealing the space between the two electrodes. Typically, the assembly, glass sealing and evacuation process involves substantial heating of the device (e.g., 300-600° C.). This heating step may substitute for the heating step C in FIG. 1. Similarly, a heating step during device assembly may be advantageous in the process of FIG. 5. For example, the etching step (block D in FIG. 5) of an alloy film (e.g., Au—Cu alloy) tends to produce a surface that is depleted with Cu. The heating step will allow the low $\delta_{max}$ component (Cu in this case) to diffuse to the surface so as to reduce the secondary electron emission.

Figure 8:
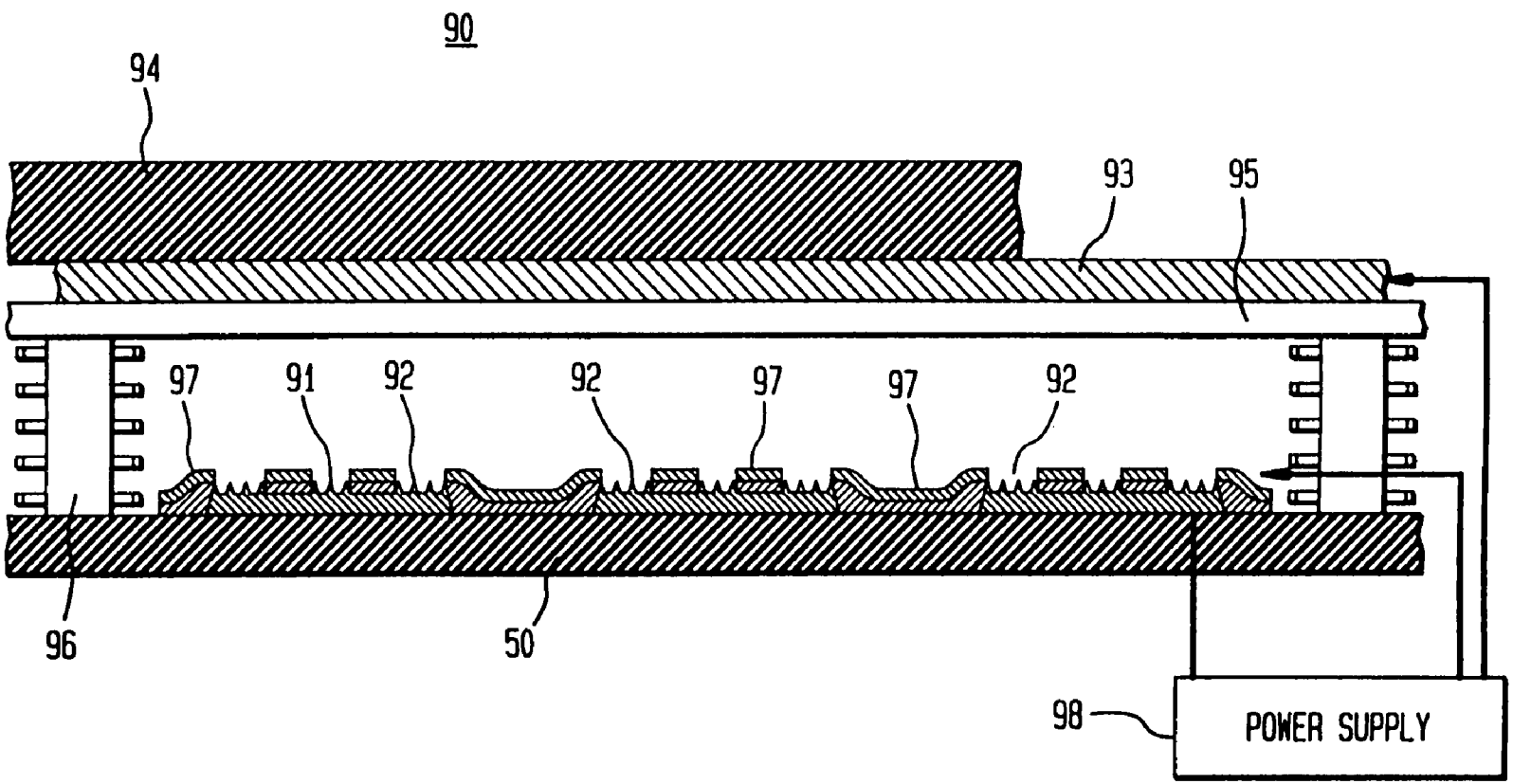
FIG. 8 schematically illustrates an exemplary FED device comprising the conductor-coated corrugated pillars.

The preferred use of these corrugated pillars is in the fabrication of field emission devices such as electron emission flat panel displays. FIG. 8 is a schematic cross section of an exemplary flat panel display 90 using the high breakdown voltage pillars according to the present invention. The display comprises a cathode 91 including a plurality of emitters 92 and an anode 93 disposed in spaced relation from the emitters within a vacuum seal. The anode conductor 93 formed on a transparent insulating substrate 94 is provided with a phosphor layer 95 and mounted on support pillars 96. Between the cathode and the anode and closely spaced from the emitters is a perforated conductive gate layer 97.

The space between the anode and the emitter is sealed and evacuated, and voltage is applied by power supply 98. The field-emitted electrons from electron emitters 92 are accelerated by the gate electrode 97 from multiple emitters 92 on each pixel and move toward the anode conductive layer 93 (typically transparent conductor such as indium-tin-oxide) coated on the anode substrate 94. Phosphor layer 95 is disposed between the electron emitters and the anode. As the accelerated electrons hit the phosphor, a display image is generated.

It is to be understood that the above-described embodiments are illustrative of only a few of the many possible specific embodiments which can represent applications of the principles of the invention. For example, the high breakdown voltage pillars of this invention can be used not only for flat-panel display apparatus but for other applications, such as a x-y matrix addressable electron sources for electron lithography or for microwave power amplifier tubes. Thus numerous and varied other arrangements can be made by those skilled in the art without departing from the spirit and scope of the invention.

The invention claimed is:

1. In an electron field emission device comprising an emitter cathode, an anode and a plurality of insulating pillars separating said cathode and anode, the improvement wherein:

at least one said pillar comprises a corrugated rod of insulating material, said corrugations comprising ridges and recessed regions, and said ridges of said corrugations are selectively coated with conductive material having a secondary electron emission coefficient in the range 0.9-1.4 and the recessed regions are not coated with said conductive material.

2. The device of claim 1 wherein said conductive material comprises a material selected from the group consisting of Cu, Co, Ni, Ti, Au, $Cu_2O$ and $Ag_2O$.

3. The device of claim 1 wherein said conductive material has a thickness in the range 0.005-50 μm.

4. The device of claim 1 wherein said conductive material has a thickness in the range 0.1-2.0 μm.

5. The device of claim 1 wherein said pillar has a diameter in the range 50-1000 μm.

6. The device of claim 1 wherein said pillar has a diameter in the range 100-300 μm.

7. The device of claim 1 wherein said pillar has a height-to-diameter aspect ratio of 1:10.

8. The device of claim 1 wherein said pillar has a height-to-diameter aspect ratio of 2:5.

* * * * *